US010207164B2

(12) United States Patent
Hsu et al.

(10) Patent No.: US 10,207,164 B2
(45) Date of Patent: Feb. 19, 2019

(54) WATERPROOF RACKET

(71) Applicants: Huang-Keng Hsu, El Monte, CA (US); Chin-Yih Chen, New Taipei (TW)

(72) Inventors: Huang-Keng Hsu, El Monte, CA (US); Chin-Yih Chen, New Taipei (TW)

( * ) Notice: Subject to any disclaimer, the term of this patent is extended or adjusted under 35 U.S.C. 154(b) by 11 days.

(21) Appl. No.: 15/229,090

(22) Filed: Aug. 4, 2016

(65) Prior Publication Data

US 2018/0036611 A1 Feb. 8, 2018

(51) Int. Cl.

| | |
|---|---|
| ***A63B 59/00*** | (2015.01) |
| ***A63B 59/48*** | (2015.01) |
| ***A63B 60/22*** | (2015.01) |
| ***A63B 60/40*** | (2015.01) |
| ***A63B 59/40*** | (2015.01) |
| *A63B 49/08* | (2015.01) |
| *A63B 51/04* | (2006.01) |
| *A63B 71/00* | (2006.01) |
| *A63B 49/035* | (2015.01) |
| *A63B 51/01* | (2015.01) |
| *A63B 60/14* | (2015.01) |

(52) U.S. Cl.

CPC ..... *A63B 59/48* (2015.10); *A63B 59/40* (2015.10); *A63B 60/22* (2015.10); *A63B 60/40* (2015.10); *A63B 49/035* (2015.10); *A63B 49/08* (2013.01); *A63B 51/01* (2015.10); *A63B 51/04* (2013.01); *A63B 60/14* (2015.10); *A63B 2071/0063* (2013.01)

(58) Field of Classification Search

CPC ..... A63B 51/04; A63B 59/00; A63B 59/40; A63B 59/48; A63B 59/80; A63B 60/00; A63B 69/38; A63B 60/14; A63B 60/22; A63B 60/40; A63B 49/035; A63B 49/08; A63B 51/01; A63B 2071/0063

See application file for complete search history.

(56) References Cited

U.S. PATENT DOCUMENTS

| | | | | | |
|---|---|---|---|---|---|
| 3,048,399 | A * | 8/1962 | Breitbach | A63B 51/04 | 473/457 |
| 5,131,653 | A * | 7/1992 | Yu | A63B 49/10 | 473/541 |
| 5,160,147 | A * | 11/1992 | Ping | G10K 9/10 | 273/DIG. 30 |
| 5,188,359 | A * | 2/1993 | Wu | A63B 51/04 | 473/528 |
| 5,217,222 | A * | 6/1993 | Rudell | A63B 51/04 | 473/528 |
| 5,265,883 | A * | 11/1993 | Choo | A63B 59/80 | 273/DIG. 25 |
| 5,294,114 | A * | 3/1994 | Stillinger | A63B 59/00 | 473/528 |
| 5,326,097 | A * | 7/1994 | Yu | A63B 60/40 | 473/528 |

(Continued)

*Primary Examiner* — Raleigh W Chiu

(74) *Attorney, Agent, or Firm* — Raymond Y. Chan; David and Raymond Patent Firm

(57) ABSTRACT

A waterproof racket includes an annular skeleton, a receiving pocket having a pocket cavity, and a trampoline layer affixed to the receiving pocket. The annular skeleton is received in the pocket cavity to retain the receiving pocket in an annular configuration. The trampoline layer is affixed to a centerline of the receiving pocket, wherein the trampoline layer is stretched to form a trampoline surface in a tension manner.

10 Claims, 8 Drawing Sheets

(56) References Cited

U.S. PATENT DOCUMENTS

| | | | | |
|---|---|---|---|---|
| 6,402,646 | B1 * | 6/2002 | Wolf | A63B 49/00 473/528 |
| 6,910,978 | B2 * | 6/2005 | Cooper | A63B 49/08 473/521 |
| 2013/0210313 | A1 * | 8/2013 | Williams | A63H 27/00 446/46 |

* cited by examiner

WATERPROOF RACKET

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to sports activity apparatus, and more particularly to a racket, such as waterproof racket or bouncing pad, which comprises a trampoline layer retained along a centerline of a racket frame for establishing optimal handling characteristics.

Description of Related Arts

In the prior art, sports activity implements, such as flying discs or racket apparatus, are known. A common feature of the flying disc and the racket apparatus is that an elastic layer is retained within an annular frame. For example, U.S. Pat. No. 8,241,153 relates to a sports activity device which comprises an outer annular ring member, an inner annular ring assembly detachably engaged to the outer annular ring member, wherein a flexible material that stretches across an annular area within the inner ring assembly. However, such sports activity device has several drawbacks.

Accordingly, the inner ring assembly comprises an annular ring member defining the annular area therewithin to retain the flexible material within the annular ring member. The outer annular ring member has an inner circular cavity to receive the annular ring member.

Since the inner annular ring assembly is detachably engaged to the outer annular ring member by receiving the annular ring member within the inner circular cavity of the outer annular ring member, the inner annular ring assembly may accidentally detach from the outer annular ring member, especially when the engagement therebetween is not securely mounted. For example, when throwing the sports activity device as the flying disc, the centrifugal force may drive the inner annular ring assembly to detach from the outer annular ring member. Especially when the centrifugal force is exerted at the annular ring member, the centrifugal force will force the annular ring member to be moved within the inner circular cavity. When using the sports activity device as the racket apparatus, the reaction force at the flexible material may also drive the inner annular ring assembly to detach from the outer annular ring member.

Accordingly, the flexible material is mounted by the inner annular ring member of the inner annular ring assembly. In particular, the peripheral edge of the flexible material is affixed to an inner surface of the inner annular ring member via the inner circular cavity. As a result, the tension of the flexible material is preset by the size of the inner annular member. In other words, the tension of the flexible material cannot be adjusted. Furthermore, when any portion of the inner annular ring member is damaged or broken, the flexible material cannot be mounted in a tension manner. Since the inner annular ring member is made of rigid material, it is difficult to securely mount the flexible material to the inner annular ring member. Therefore, the manufacturing process will be complicated to securely mount the flexible material to the inner annular ring member.

The inner circular cavity is formed at the inner side of the outer annular ring member to detachably receive the inner annular ring member. In particular, the inner circular cavity is formed at an upper side of the outer annular ring member, such that when the inner annular ring member is mounted at the inner circular cavity, the flexible material is aligned with the upper side of the outer annular ring member. In other words, an outer diameter of the inner annular ring member is larger than an inner diameter of the outer annular ring member. This off-centerline engagement between the outer and inner annular ring members will provide uneven tensions of the flexible material at two opposite sides of the outer annular ring member. Therefore, the user, especially a young kid, has difficulty to handle the sports activity device to play as the racket apparatus. It is worth mentioning that the inner circular cavity cannot be formed at a centerline of the outer annular ring member because the inner annular ring member cannot mounted to the inner circular cavity.

Another drawback of the sports activity device is that the outer annular ring member must be made by foam material. In order to form the inner circular cavity at the outer annular ring member, the outer annular ring member must be made of rigid material. Otherwise, the inner annular ring member cannot be securely held by the outer annular ring member. In other words, the sports activity device does not provide any cushioning effect, such that when playing the sports activity device as the flying disc or the racket apparatus, the user, especially a young kid, may accidentally hit by the outer annular ring.

In addition, the foam outer annular ring member must be rigid enough to hold the inner annular ring member in position. Otherwise, the soft foam outer annular ring member cannot retain the inner annular ring member. In addition, the service life span of the foam outer annular ring member is relatively short, wherein once the foam material will be hardened and cracked, the inner annular ring member will be detected from the outer annular ring member.

SUMMARY OF THE PRESENT INVENTION

The invention is advantageous in that it provides a waterproof racket, which comprises a trampoline layer retained at least a portion of a racket frame for establishing optimal handling characteristics. Preferably, the trampoline layer is retained along a centerline of the racket frame.

Another advantage of the invention is to a waterproof racket, wherein an annular skeleton is encircled within a receiving pocket to retain the receiving pocket in an annular configuration. Cushioning element can be selectively received in the receiving pocket to form a cushioning pocket that is soft enough to provide a cushioning effect but is rigid enough to retain the shape of the receiving pocket via the annular skeleton.

Another advantage of the invention is to a waterproof racket, wherein the shape of the receiving pocket can be altered by the shape of the annular skeleton, such that the shape of the waterproof racket can be configured to have a circular shape by using a circular annular skeleton or can be configured to have an oval shape by using an oval annular skeleton.

Another advantage of the invention is to a waterproof racket, wherein the trampoline layer is directly affixed to the receiving pocket to ensure the trampoline layer to be located at the centerline of the receiving pocket. In other words, the trampoline layer is alignedly extended from an inner peripheral side of the receiving pocket at the centerline, such that the upper half of the receiving pocket above the trampoline layer is symmetrical to the lower half of the receiving pocket below the trampoline layer to enhance the handling of the waterproof racket.

Another advantage of the invention is to a waterproof racket, wherein the annular skeleton is encirclingly wrapped by a cushioning element of the receiving pocket to prevent any hard touching feel of the waterproof racket.

Another advantage of the invention is to a waterproof racket, wherein the racket handle can be detachably coupled to the annular skeleton through the receiving pocket. Therefore, the present invention serves as a flying disc by detaching the racket handle from the annular skeleton and serves as a racket apparatus by attaching the racket handle to the annular skeleton.

Another advantage of the invention is to a waterproof racket, wherein the manufacturing process of the waterproof racket is simplified and easy by simply affixing two affixing edges of the outer sleeve to form a tubular configuration and receiving the annular skeleton therein.

Another advantage of the invention is to a waterproof racket, wherein the tension of the trampoline layer can be selectively adjusted by adjusting an annular size of the annular skeleton.

Another advantage of the invention is to a waterproof racket, which does not require to alter the original structural design of the racket apparatus, so as to minimize the manufacturing cost of the waterproof racket incorporating with the existing racket accessories.

Another advantage of the invention is to a waterproof racket, wherein no expensive or complicated structure is required to employ in the present invention in order to achieve the above mentioned objects. Therefore, the present invention successfully provides an economic and efficient solution for providing a rigid configuration and a cushioning effect for the waterproof racket.

Additional advantages and features of the invention will become apparent from the description which follows, and may be realized by means of the instrumentalities and combinations particular point out in the appended claims.

According to the present invention, the foregoing and other objects and advantages are attained by a waterproof racket, comprising:

a racket frame which comprises an annular skeleton which is made of rigid material, and a waterproof receiving pocket having a pocket cavity, wherein the annular skeleton is received in the pocket cavity to retain the receiving pocket in an annular configuration; and a trampoline layer affixed to the receiving pocket along a centerline thereof, wherein the trampoline layer is stretched to form a trampoline surface in a tension manner.

In accordance with another aspect of the invention, the present invention comprises a method of manufacturing a waterproof racket, comprising the following steps.

(1) Form a tubular waterproof receiving pocket which has a pocket cavity therein.

(2) Receive an annular skeleton, which is made of rigid material, within the pocket cavity of the receiving pocket to retain the receiving pocket in an annular configuration.

(3) Affix at least a portion of a trampoline layer to the receiving pocket along a centerline thereof, wherein the trampoline layer is stretched to form a trampoline surface in a tension manner.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 2:
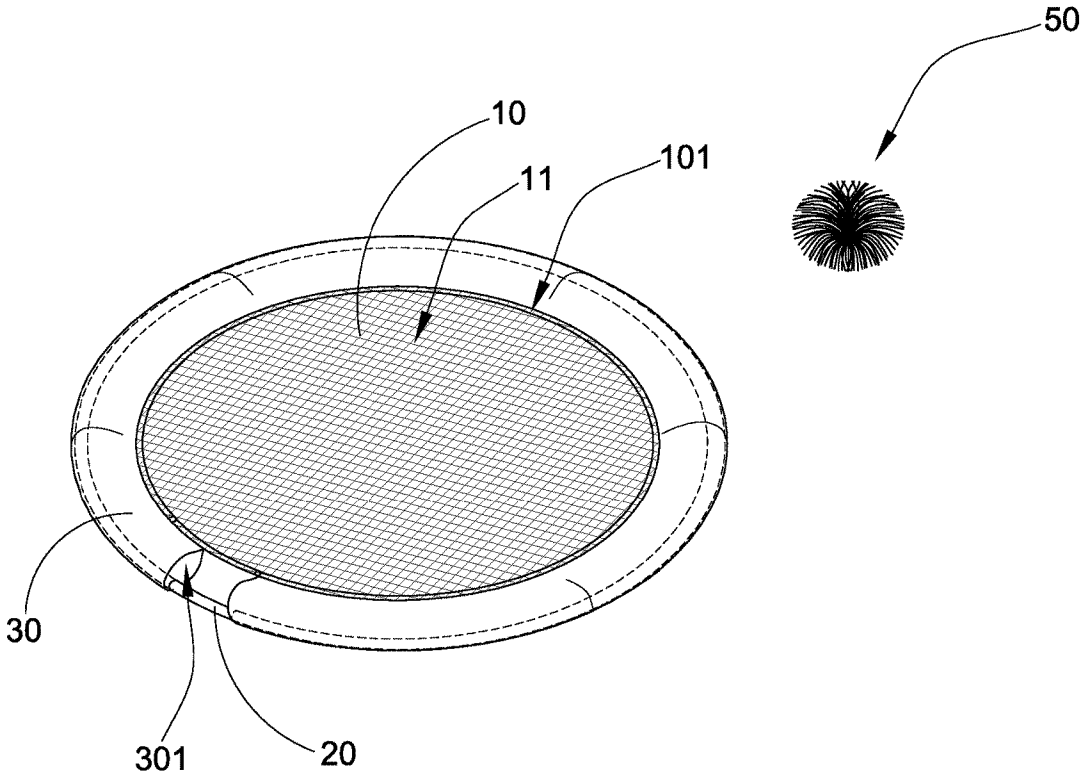
FIG. 2 is a perspective view of a waterproof racket according to a first preferred embodiment of the present invention.
Figure 3:
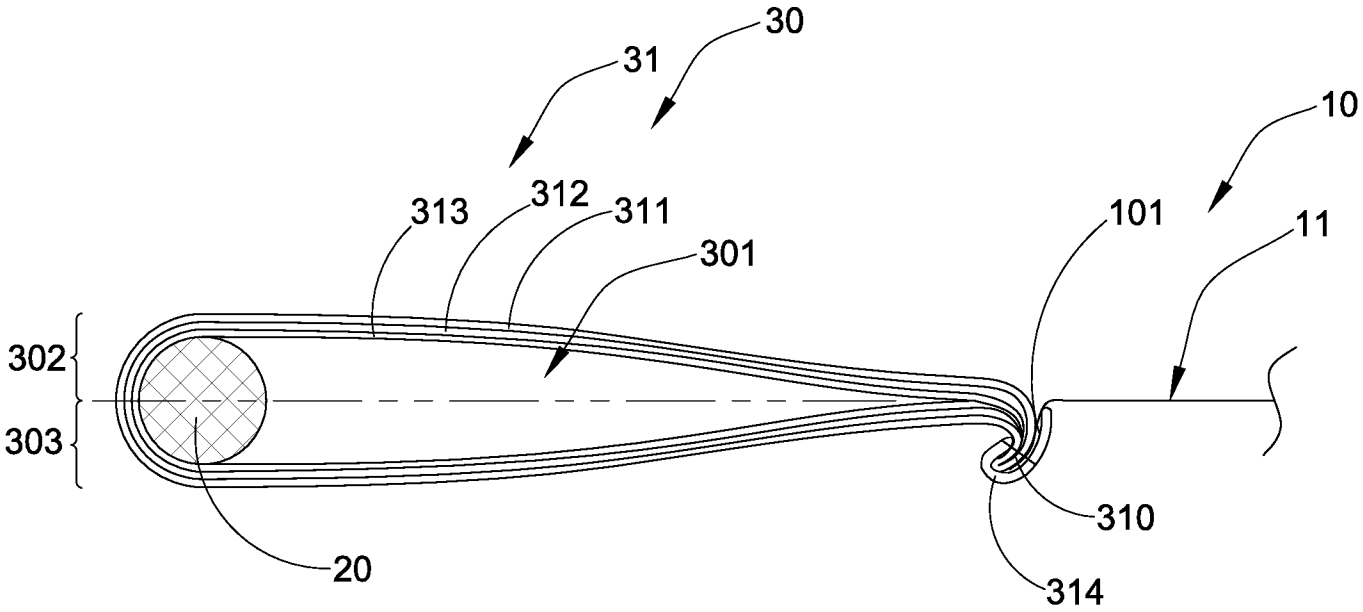
FIG. 3 is a partially sectional view of the waterproof racket according to the above first preferred embodiment of the present invention.

Referring to FIGS. 2 and 3 of the drawings, a waterproof racket according to a preferred embodiment of the present invention is illustrated, wherein the waterproof racket is embodied as a bouncing pad according to the present invention. The waterproof racket comprises a racket frame and a trampoline layer 10 supported by the racket frame.

According to the preferred embodiment, the racket frame comprises an annular skeleton 20 and a receiving pocket 30 having a pocket cavity 301, wherein the annular skeleton 20 is received in the pocket cavity 301 to retain the receiving pocket 30 in an annular configuration. The receiving pocket 30 is made of waterproof material.

Figure 1:
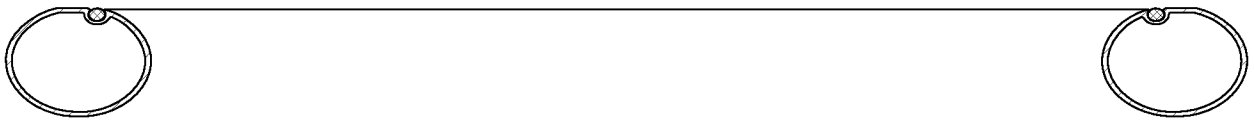
FIG.1 PRIOR ART
FIG. 1 illustrates a conventional waterproof racket.

Accordingly, the annular skeleton 20 is made of rigid material such as plastic or metal. The annular skeleton 20 can be configured to have different shapes and sizes, such as circular shape or oval shape. In one embodiment, the annular skeleton 20 is configured to have a circular shape as shown in FIGS. 1 and 2. When the annular skeleton 20 is received in the pocket cavity 301 of the receiving pocket 30, the shape of the receiving pocket 30 is retained by the annular skeleton 20. Preferably, the annular skeleton 20 is made of flexible material, wherein when the annular skeleton 20 is configured into a loop form, the annular skeleton 20 provides an outward and radial stretching force to provide a predetermined rigidity of the annular skeleton 20.

The receiving pocket 30 comprises an outer sleeve 31 defining the pocket cavity 301 therein. As shown in FIG. 3, the outer sleeve 31 is constructed with multiple layers. In particular, the outer sleeve 31 comprises an outer waterproof layer 311, a cushioning layer 312, and an inner lining 313, wherein the cushioning layer 312 is adhered between the outer waterproof layer 311 and the inner lining 313.

Accordingly, the outer sleeve 31 is folded to form the pocket cavity 301 therewithin. Two affixing edges of the outer sleeve 31 are affixed together to form an annular affixing brim 310 at an inner side of the outer sleeve 31 in order to form the pocket cavity 301 within the outer sleeve 31. It is worth mentioning that when the affixing edges of the outer sleeve 31 are affixed together, the outer sleeve 31 forms a tubular configuration to form the pocket cavity 301. A reinforcing layer 314 is provided to affix along the annular affixing brim 310 of the outer sleeve 31 to retain the attachment of the affixing edges of the outer sleeve 31. It is worth mentioning that the affixing edges of the outer sleeve 31 are affixed and overlappedly folded to form the annular affixing brim 310.

As shown in FIG. 3, the peripheral edge 101 of the trampoline layer 10 is affixed to the annular affixing brim 310 of the outer sleeve 31 to retain the trampoline layer 10 within the inner peripheral of the receiving pocket 30. Furthermore, the reinforcing layer 314 is provided to affix along the annular affixing brim 310 of the outer sleeve 31 with the peripheral edge 101 of the trampoline layer 10 to ensure the attachment of the affixing edges of the outer sleeve 31 and the attachment of the peripheral edge of the trampoline layer 10 along the annular affixing brim 310 of the outer sleeve 31. Accordingly, the reinforcing layer 314 is half-folded to sandwich and affix to the annular affixing brim 310 of the outer sleeve 31 and the peripheral edge 101 of the trampoline layer 10. In other words, the reinforcing layer 314, having a U-shaped cross section, affixedly encloses the annular affixing brim 310 of the outer sleeve 31 and the peripheral edge 101 of the trampoline layer 10.

According to the preferred embodiment, the trampoline layer 10 has at least a portion affixed to the receiving pocket 30, wherein the trampoline layer 10 is stretched to form a trampoline surface 11 in a tension manner. Preferably, the trampoline layer 10 is affixed to the receiving pocket 30 along a centerline thereof. The trampoline layer 10 is made of elastic material, wherein the trampoline layer 10 will provide a predetermined tension for catching or rebounding an object when the trampoline layer 10 is stretched. Accordingly, the trampoline surface 11 of the trampoline layer 10 has a planar configuration.

Accordingly, the peripheral edge 101 of the trampoline layer 10 is affixed to an inner peripheral of the receiving pocket 30. The centerline of the receiving pocket 30 is defined by the trampoline layer 10 to form an upper half 302 of the receiving pocket 30 and a lower half 303 of the receiving pocket 30. In other words, the upper half 302 of the receiving pocket 30 above the trampoline layer 10 is symmetrical to the lower half 303 of the receiving pocket 30 below the trampoline layer 10 to enhance the handling of the waterproof racket.

Therefore, the user is able to use either side of the racket frame to ensure the tension of the trampoline surface 11 of the trampoline layer 10. For example, when using the waterproof racket to play the racket sports by hitting a bouncy ball 50 with the trampoline layer 10, the tension of the trampoline surface 11 of the trampoline layer 10 for the forehand play is the same as the tension of the trampoline surface 11 of the trampoline layer 10 for the backhand play. It is worth mentioning that the user is able to grip a portion of the racket frame to hit the bouncy ball 50. Likewise, the waterproof racket can be embodied as a flying disc, such that the user is able to throw and catch the waterproof racket. It is worth mentioning that the flying disc will be bounced when the flying disc is thrown to hit on the ground, the wall, or any surface.

Figure 4:
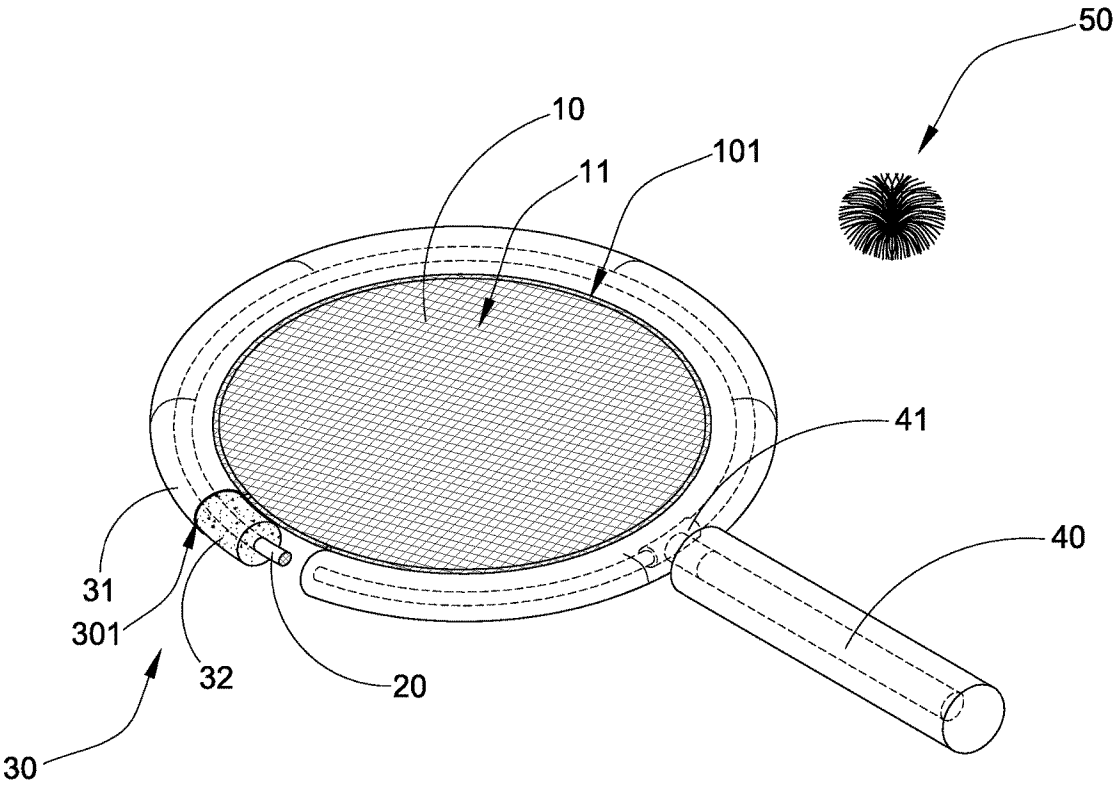
FIG. 4 is a perspective view of a waterproof racket according to a second preferred embodiment of the present invention.
Figure 5:
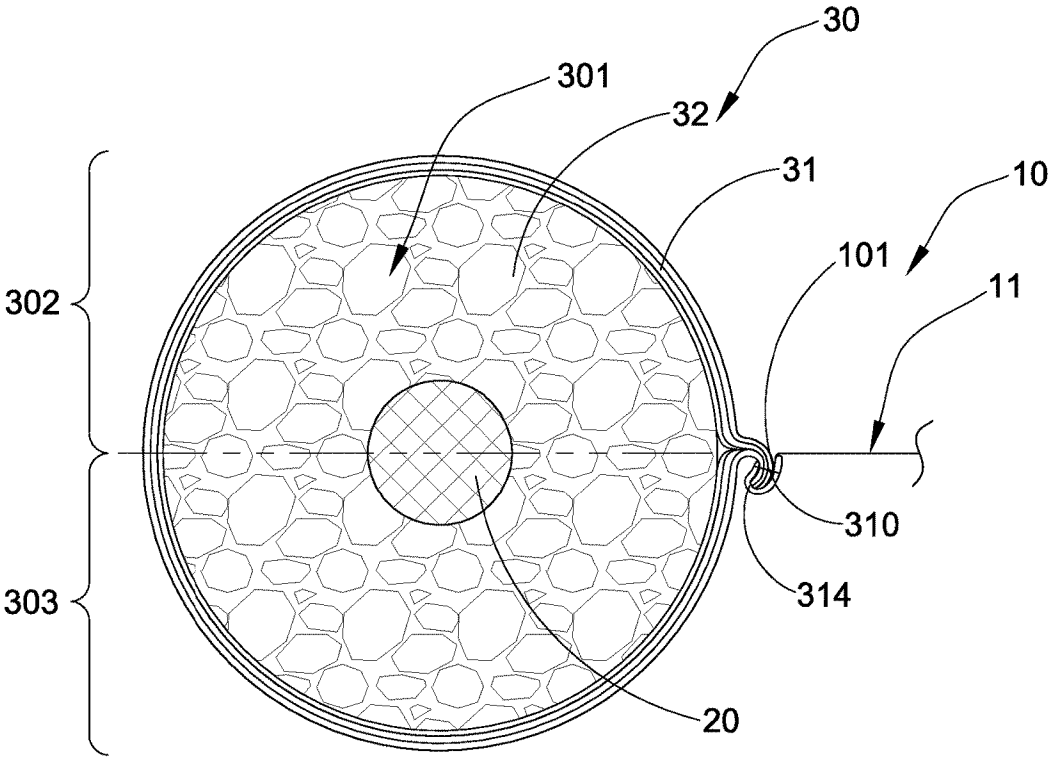
FIG. 5 is a partially sectional view of the waterproof racket according to the above second preferred embodiment of the present invention.

As shown in FIGS. 4 and 5, a waterproof racket according to a second embodiment illustrates a modification of the first embodiment, wherein the receiving pocket 30 further comprises a cushioning element 32 received in the outer sleeve 31. The cushioning element 32 is preferably made of soft foaming material to provide a soft and cushioning feel for the receiving pocket 30. Preferably, the annular skeleton 20 is encirclingly wrapped by the cushioning element 32 to prevent the user directly contacting with the annular skeleton 20. In other words, the receiving pocket 30 is soft enough to provide a cushioning effect via the cushioning element 32 but is rigid enough to retain the shape of the receiving pocket 30 via the annular skeleton 10.

The size of the pocket cavity 301 of the receiving pocket 30 is configured to fit the predetermined amount of cushioning element 32. In other words, in order to enhance the cushioning effect of the racket frame, the size of the pocket cavity 301 is increase to receive more amount of cushioning element 32. It is appreciated that the cushioning element 32 can be integrally formed with the cushioning layer 312. Therefore, the thickness of the cushioning layer 312 can be increased as integrating the cushioning element 32 with the cushioning layer 312 to enhance the cushioning effect of the racket frame.

According to the preferred embodiment, the racket frame further comprises an elongated racket handle 40 extended from the annular skeleton 20 through the receiving pocket 30. Preferably, the racket handle 40 is coupled to the annular skeleton 20 via a handle connector 41. In one embodiment, the handle connector, having a T-shape, has a skeleton connecting portion and a handle connecting portion. The skeleton connecting portion of the handle connector is connected to a portion of the annular skeleton. One end of the racket handle 40 is connected to the handle connecting portion of the handle connector.

It is appreciated that the racket handle 40 is detachably coupled to the handle connecting portion of the handle connector 41. For example, the racket handle 40 has a threaded end and the skeleton connecting portion of the handle connector 41 has a threaded slot, wherein the threaded end of the racket handle 40 is rotatably and detachably coupled with the threaded slot of the skeleton connecting portion of the handle connector 41. Therefore, the racket frame serves as a flying disc by detaching the racket handle 40 from the annular skeleton 20 and serves as a racket apparatus by attaching the racket handle 40 to the annular skeleton 20.

Figure 6:
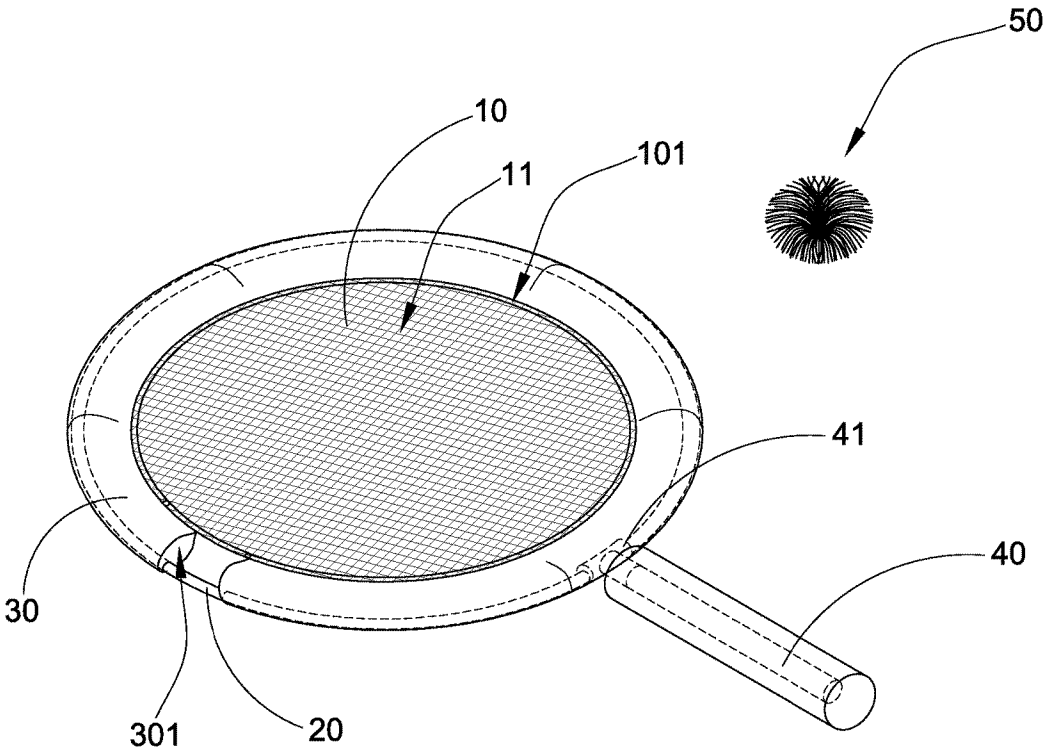
FIG. 6 is a perspective view of a waterproof racket according to a third preferred embodiment of the present invention.

As shown in FIG. 6, a waterproof racket according to a third embodiment illustrates a modification of the second embodiment, wherein the waterproof racket of the third embodiment has the same structural configuration except no cushioning element received in the outer sleeve 31. Therefore, the annular skeleton 20 is received in the outer sleeve 31 as shown in the first embodiment.

Figure 7:
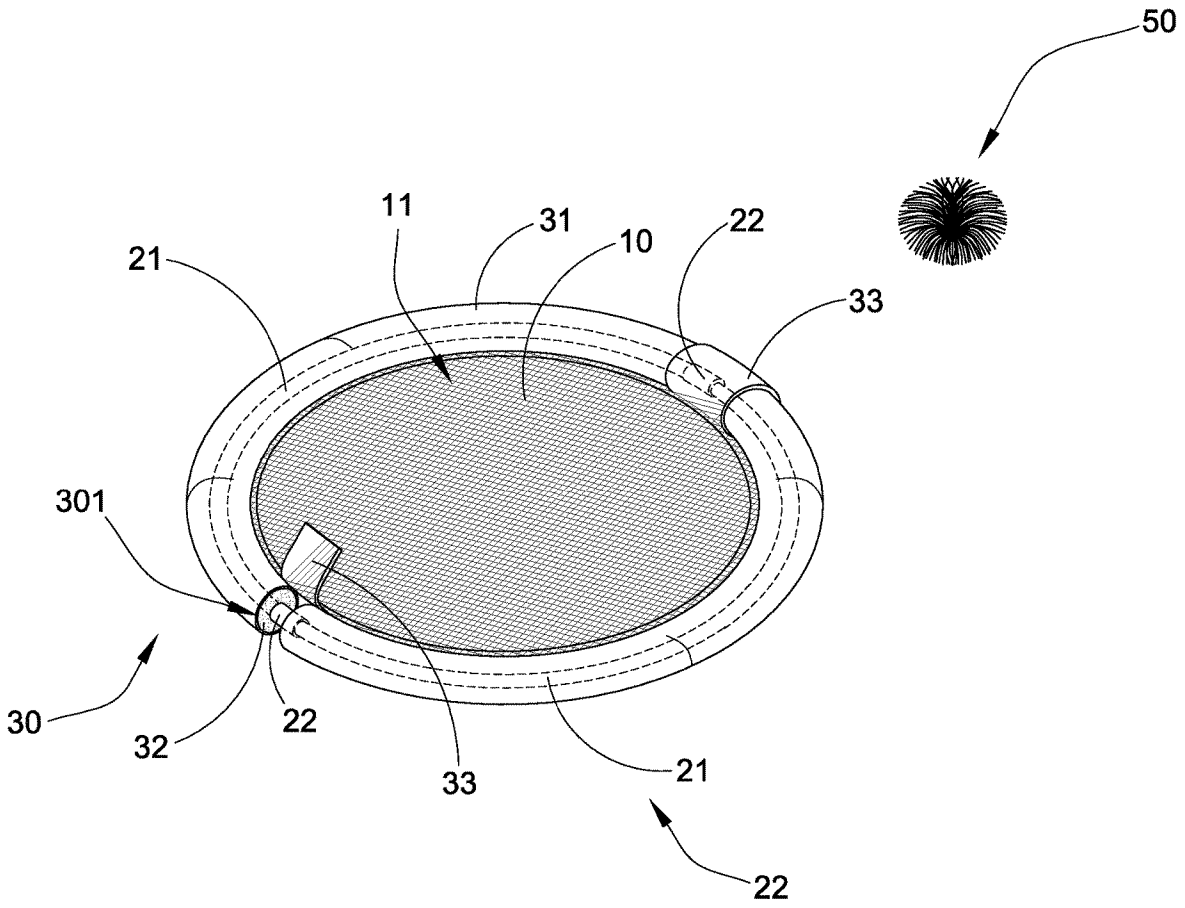
FIG. 7 is a perspective view of a modification of the racket frame of the waterproof racket according to the above first to third preferred embodiments of the present invention, illustrating the adjustment of an annular size of the annular skeleton.
Figure 8:
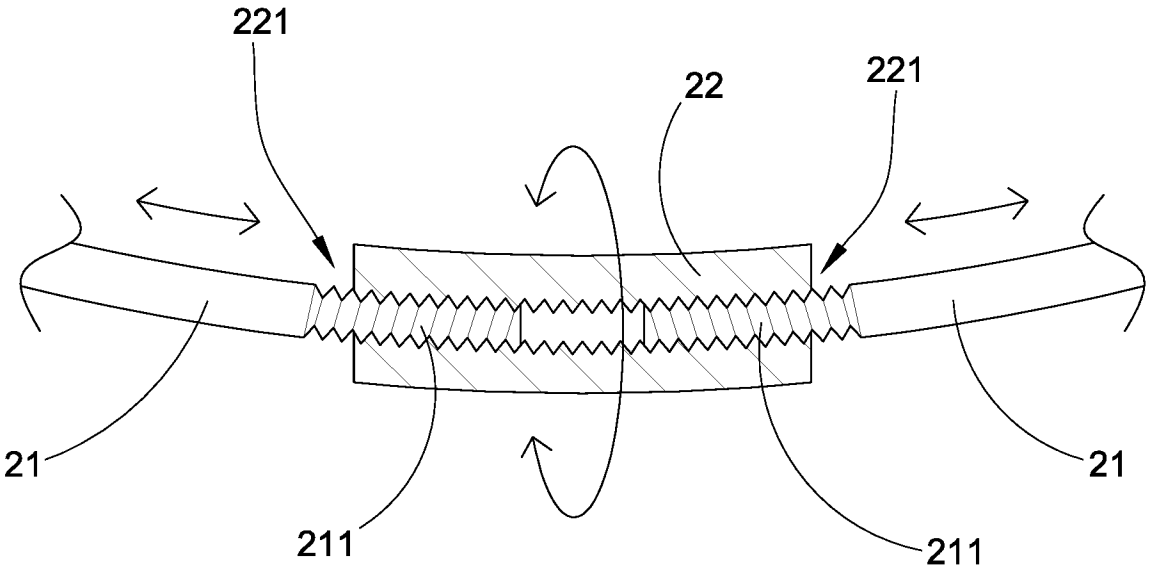
FIG. 8 illustrates an adjustable connector of the annular skeleton of the modified racket frame according to the above first to third preferred embodiments of the present invention.

FIGS. 7 and 8 illustrate a modification of the waterproof racket according to the above first to third embodiment, which can selectively adjust the tension of the trampoline layer 10. As shown in FIG. 7, the annular skeleton 20 comprises a plurality of skeleton arms 21 and a plurality of adjustable connectors 22 that connect the skeleton arms 21 end-to-end to selectively adjust an annular size of the annular skeleton 20. Accordingly, each of the skeleton arms 21 has two threaded end portions 211, wherein each of the adjustable connectors 22 has two side threaded opening slots 221 rotatably coupled with the threaded end portions 211 of two of the skeleton arms 21. Preferably, at least two skeleton arms 21 and two adjustable connectors 22 are provided to couple the skeleton arms 21 end-to-end to form the annular skeleton 20. Therefore, when the adjustable connector 22 is rotated at one direction, the threaded end portions 211 of the skeleton arms 21 are moved away from each other to enlarge the annular size of the annular skeleton 20. When the annular size of the annular skeleton 20 is enlarged, the receiving pocket 20 is stretched outwardly in a radial direction, such that the trampoline layer 10 is stretched correspondingly in a radial direction to increase the tension of the trampoline layer 10. When the adjustable connector 22 is rotated at an opposite direction, the threaded end portions 211 of the skeleton arms 21 are moved toward from each other to reduce the annular size of the annular skeleton 20. When the annular size of the annular skeleton 20 is reduced, the receiving pocket 20 has less stretch to reduce the tension of the trampoline layer 10.

In order to allow the user to access the adjustable connectors 22, the receiving pocket 20 further comprises a foldable leaf 33 affixed to the outer sleeve 31 at an opening slit thereof to selectively enclose the pocket cavity 301. When the foldable leaf 33 is unfolded from the outer sleeve 31 to expose the pocket cavity 301, the user is able to rotate the adjustable connectors 22 to selectively adjust the annular size of the annular skeleton 20. When the foldable leaf 33 is folded on the outer sleeve 31, the opening slit of the outer sleeve 31 is covered to enclose the adjustable connectors 22 within the pocket cavity 301.

Accordingly, the present invention further provides a manufacturing method of the waterproof racket, which comprises the following steps.

(1) Form the tubular waterproof receiving pocket 30 which has the pocket cavity 301 therein. Accordingly, in order to form the receiving pocket 30, the step (1) further comprises the following steps.

(1.1) Forming the waterproof outer sleeve 31.

(1.2) Fold the outer sleeve 31 and affix two affixing edges of the outer sleeve 31 with each other to form the annular affixing brim 310 at the inner side of the outer sleeve 31 so as to form the pocket cavity 301 within the outer sleeve 31.

(1.3) Optionally, receive the cushioning element 32 in the tubular outer sleeve 31 to form the receiving pocket 30.

(2) Receive the annular skeleton 20 within the pocket cavity 301 of the receiving pocket 30 to retain the receiving pocket 30 in an annular configuration. Preferably, the annular skeleton 20 is encirclingly wrapped by the cushioning element 32.

(3) Affix at least a portion of the trampoline layer 10 to the receiving pocket 20 along the centerline thereof, such that the trampoline layer 10 is stretched to form the trampoline surface 11 in a tension manner. In particularly, the peripheral edge of the trampoline layer 10 is affixed to the annular affixing brim 310 of the outer sleeve 31 to retain the trampoline layer 10 within the inner peripheral of the receiving pocket 20. Optionally, the reinforcing layer 314 is affixed to the annular affixing brim 310 of the outer sleeve 31 and the peripheral edge of the trampoline layer 10.

(4) Optionally, couple the racket handle 40 at the annular skeleton through the receiving pocket 20. Accordingly, the step (4) further comprises the following steps.

(4.1) Provide the handle connector 41.

(4.2) Connect the annular skeleton 30 at the skeleton connecting portion of the handle connector 41.

(4.3) Connect one end of the racket handle 40 to the handle connecting portion of the handle connector 41.

Therefore, the user is able to play the racket frame as a flying disc by detaching the racket handle 40 from the annular skeleton 20 and to use the racket frame as a racket apparatus by attaching the racket handle 40 to the annular skeleton 20 via the handle connector 41.

It is worth mentioning that when the racket frame incorporates with the adjustable connectors 22, the user is able to selectively adjust the tension of the trampoline layer 10 by adjusting the annular size of the annular skeleton 20.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A waterproof racket, comprising:

a racket frame, comprising an annular skeleton and a receiving pocket having a pocket cavity, wherein said annular skeleton is received in said pocket cavity to retain said receiving pocket in an annular configuration, wherein said receiving pocket comprises an outer sleeve having two affixing edges affixing with each other to form an annular affixing brim at an inner side of said outer sleeve so as to form said pocket cavity within said outer sleeve; and a trampoline layer having at least a portion affixed to said receiving pocket, wherein said trampoline layer is stretched to form a trampoline surface in a tension manner.

2. The waterproof racket, as recited in claim 1, wherein said trampoline layer is affixed to said receiving pocket along a centerline thereof that an upper half of said receiving pocket above said trampoline layer is symmetrical to a lower half of said receiving pocket below said trampoline layer.

3. The waterproof racket, as recited in claim 2, wherein a peripheral edge of said trampoline layer is affixed to said annular affixing brim of said outer sleeve to retain said trampoline layer within an inner peripheral of said receiving pocket.

4. The waterproof racket, as recited in claim 3, wherein said receiving pocket further comprises a reinforcing layer affixed along said annular affixing brim of said outer sleeve with said peripheral edge of said trampoline layer.

5. The waterproof racket, as recited in claim 4, wherein said receiving pocket comprises a cushioning element received in said pocket cavity.

6. The waterproof racket, as recited in claim 5, wherein said annular skeleton is encirclingly wrapped by said cushioning element.

7. The waterproof racket, as recited in claim 1, wherein a peripheral edge of said trampoline layer is affixed to said annular affixing brim of said outer sleeve to retain said trampoline layer within an inner peripheral of said receiving pocket.

8. The waterproof racket, as recited in claim 7, wherein said receiving pocket further comprises a reinforcing layer affixed along said annular affixing brim of said outer sleeve with said peripheral edge of said trampoline layer.

9. A waterproof racket, comprising:

a racket frame, comprising an annular skeleton and a receiving pocket having a pocket cavity, wherein said annular skeleton is received in said pocket cavity to retain said receiving pocket in an annular configuration, wherein said annular skeleton comprises a plurality of skeleton arms and a plurality of adjustable connectors that connect said skeleton arms end-to-end to selectively adjust an annular size of said annular skeleton; and a trampoline layer having at least a portion affixed to said receiving pocket, wherein said trampoline layer is stretched to form a trampoline surface in a tension manner.

10. The waterproof racket, as recited in claim 9, wherein each of said skeleton arms has two threaded end portions, wherein each of said adjustable connectors has two side threaded opening slots rotatably coupled with said threaded end portions of two of said skeleton arms, such that when said adjustable connector is rotated at one direction, said threaded end portions of said skeleton arms are moved away from each other to enlarge said annular size of said annular skeleton, and when said adjustable connector is rotated at an opposite direction, said threaded end portions of said skeleton arms are moved toward from each other to reduce said annular size of said annular skeleton.

* * * * *